US009156664B1

(12) United States Patent
Lopez

(10) Patent No.: US 9,156,664 B1
(45) Date of Patent: Oct. 13, 2015

(54) PIÑATA HANGING AND SWINGING APPARATUS

(76) Inventor: Michael Lopez, San Diego, CA (US)

( * ) Notice: Subject to any disclaimer, the term of this patent is extended or adjusted under 35 U.S.C. 154(b) by 941 days.

(21) Appl. No.: 13/351,263

(22) Filed: Jan. 17, 2012

(51) Int. Cl.

| | |
|---|---|
| ***B66C 23/20*** | (2006.01) |
| ***B66C 23/02*** | (2006.01) |
| ***B66C 23/00*** | (2006.01) |
| *B66C 23/04* | (2006.01) |

(52) U.S. Cl.
CPC ..... *B66C 23/022* (2013.01); *B66C 23/005* (2013.01); *B66C 23/025* (2013.01); *B66C 23/04* (2013.01)

(58) Field of Classification Search
CPC .... B66C 23/022; B66C 23/04; B66C 23/025; B66C 23/005
USPC ..... 248/123.2, 122.1, 128.5, 332, 124.1, 248/125.8, 125.7; 212/179; 473/418, 429, 473/430; 254/4 R
See application file for complete search history.

(56) References Cited

U.S. PATENT DOCUMENTS

| | | | | |
|---|---|---|---|---|
| 1,887,637 | A * | 11/1932 | Hansen | 381/362 |
| 2,974,809 | A | 3/1961 | Sellars et al. | |
| 4,770,304 | A | 9/1988 | Woods | |
| 4,925,039 | A | 5/1990 | Macris | |
| 5,915,742 | A * | 6/1999 | Hung | 29/281.5 |
| 5,928,092 | A * | 7/1999 | Keeter et al. | 473/417 |
| 6,412,736 | B1 * | 7/2002 | Zaragoza | 248/125.8 |
| 7,086,820 | B1 | 8/2006 | Blake | |
| D542,501 | S | 5/2007 | Lopez | |
| 2007/0099534 | A1 | 5/2007 | Alas | |
| 2008/0073468 | A1 | 3/2008 | Arroyo | |

* cited by examiner

*Primary Examiner* — Lee D Wilson
*Assistant Examiner* — Mahdi H Nejad

(57) ABSTRACT

The piñata hanging and swinging apparatus includes a boom pipe that pivots about a vertical support via a pivot point. The boom pipe includes a handle such that the boom pipe can be animated to flail a piñata up/down/around the vertical support. The boom pipe includes a handle to enable articulation of the boom pipe, and a pulley is located at an end opposite of the handle through which a string extends to hang said piñata there from. The vertical support is secured to and rotates about a weight block that rests upon the base. An end user stands on the base while articulating the boom pipe in order to animate the piñata hanging from a string.

8 Claims, 4 Drawing Sheets

PIÑATA HANGING AND SWINGING APPARATUS

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

A. Field of the Invention

The present invention relates to the field of piñatas, more specifically, an apparatus for mechanically swinging and hanging a piñata there from.

B. Discussion of the Prior Art

As will be discussed immediately below, no prior art discloses a piñata hoisting stand that does not rely upon a string and pulley to animate the piñata, but rather includes a string and pulley to hang said piñata from a boom pipe; wherein the boom pipe attaches to a vertical support via a pivot point; wherein a handle is included on the boom pipe and enables the animation of the piñata by swinging the boom pipe up, down, or around the vertical support in order to flail the piñata thereon; the vertical support is attached to and rotates about a weight block that rests atop a base.

The Alas Patent Application Publication (U.S. Pub. No. 2007/0099534) discloses a piñata stand having a portable frame member, a pulley member and a coupling member coupled between the portable frame member and the pulley member to allow the pulley member to rotate about an axis orthogonal to pivot axis of the pulley member. However, the piñata stand does not pivot about a pivot point and rotate about a vertical support such that the piñata can be lift, lowered, and rotated.

The Arroyo Patent Application Publication (U.S. Pub. No 2008/0073468) discloses a foldable piñata stand with a pulley mechanism. However, the stand requires the use of a pulley, and not a piñata boom that pivots and rotates about a vertical support.

The Sellars et al. Patent (U.S. Pat. No. 2,974,809) discloses a floor crane. However, the floor crane is not suited for use in rapidly flinging a piñata up, down or around.

The Woods Patent (U.S. Pat. No. 4,770,304) discloses a hoisting unit having a transportable wheeled base. Again, the hoisting unit can fling a piñata around.

The Macris Patent (U.S. Pat. No. 4,925,039) discloses a portable crane. Again, the portable crane is suited for use in suspending an engine and not rapidly flailing a piñata.

The Lopez Patent (U.S. Pat. No. Des. 542,501) illustrates a design for a piñata hoisting device, which uses a pulley.

The Blake Patent (U.S. Pat. No. 7,086,820) discloses a load lifting stand. However, the stand does not have a stand that can fling a piñata up, down, or around a vertical support.

While the above-described devices fulfill their respective and particular objects and requirements, they do not describe a piñata hoisting stand that does not rely upon a string and pulley to animate the piñata, but rather includes a string and pulley to hang said piñata from a boom pipe; wherein the boom pipe attaches to a vertical support via a pivot point; wherein a handle is included on the boom pipe and enables the animation of the piñata by swinging the boom pipe up, down, or around the vertical support in order to flail the piñata thereon; the vertical support is attached to and rotates about a weight block that rests atop a base. In this regard, the piñata hanging and swinging apparatus departs from the conventional concepts and designs of the prior art.

SUMMARY OF THE INVENTION

The piñata hanging and swinging apparatus includes a boom pipe that pivots about a vertical support via a pivot point. The boom pipe includes a handle such that the boom pipe can be animated to flail a piñata up/down/around the vertical support. The boom pipe includes a handle to enable articulation of the boom pipe, and a pulley is located at an end opposite of the handle through which a string extends to hang said piñata there from. The vertical support is secured to and rotates about a weight block that rests upon the base. An end user stands on the base while articulating the boom pipe in order to animate the piñata hanging from a string.

An object of the invention is to provide a piñata articulating device that can raise, lower, and rotate said piñata.

A further object of the invention is to provide an articulating device in which an end user grabs a handle and stands on a base while maneuvering the piñata in a flailing action.

These together with additional objects, features and advantages of the piñata hanging and swinging apparatus will be readily apparent to those of ordinary skill in the art upon reading the following detailed description of presently preferred, but nonetheless illustrative, embodiments of the piñata hanging and swinging apparatus when taken in conjunction with the accompanying drawings.

In this respect, before explaining the current embodiments of the piñata hanging and swinging apparatus in detail, it is to be understood that the piñata hanging and swinging apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the piñata hanging and swinging apparatus.

It is therefore important that the claims be regarded as including such equivalent construction insofar as they do not depart from the spirit and scope of the piñata hanging and swinging apparatus. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
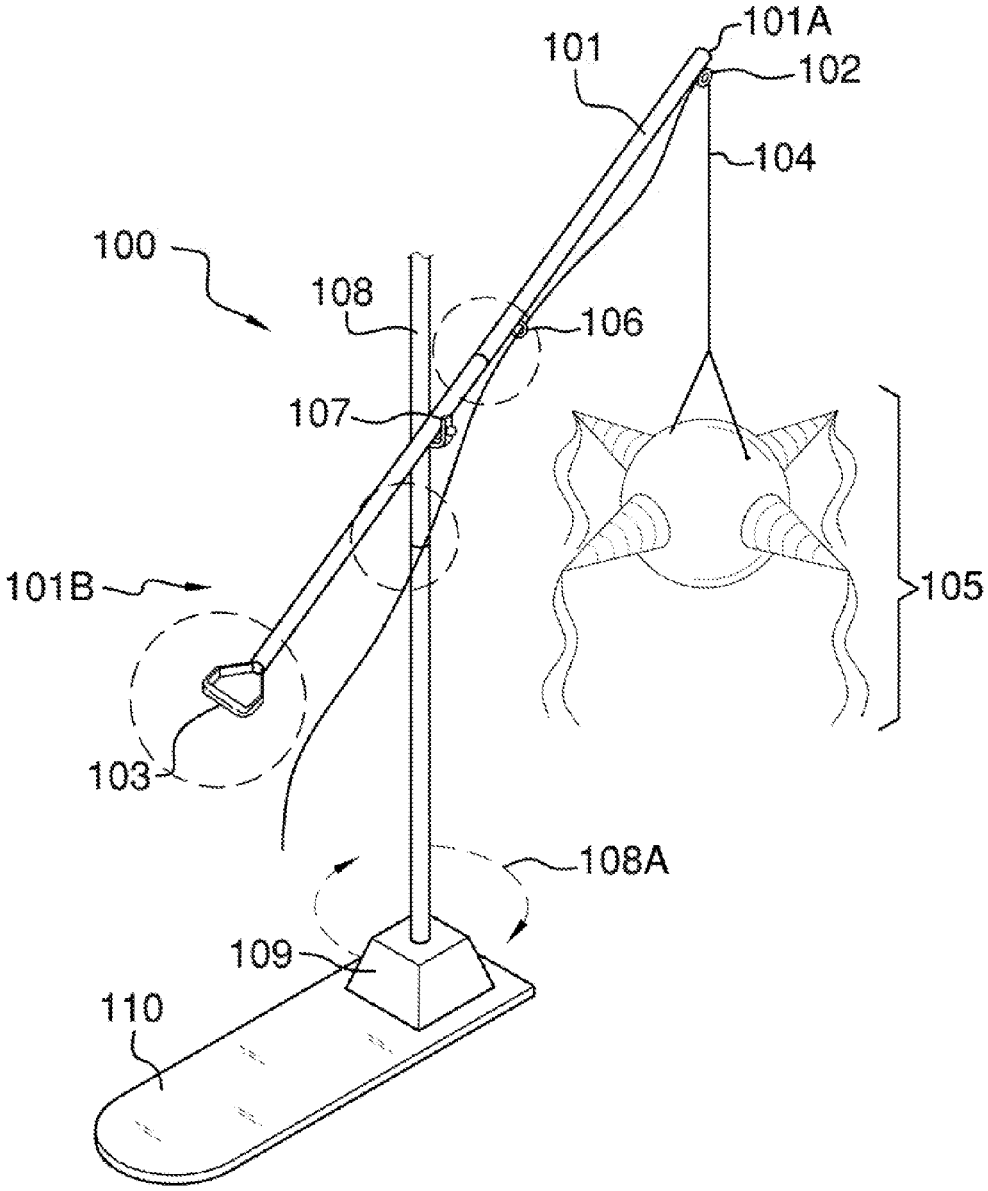
FIG. 1 illustrates an isometric view of the piñata hanging and swinging apparatus in which a piñata is suspended under a boom pipe.
Figure 2:
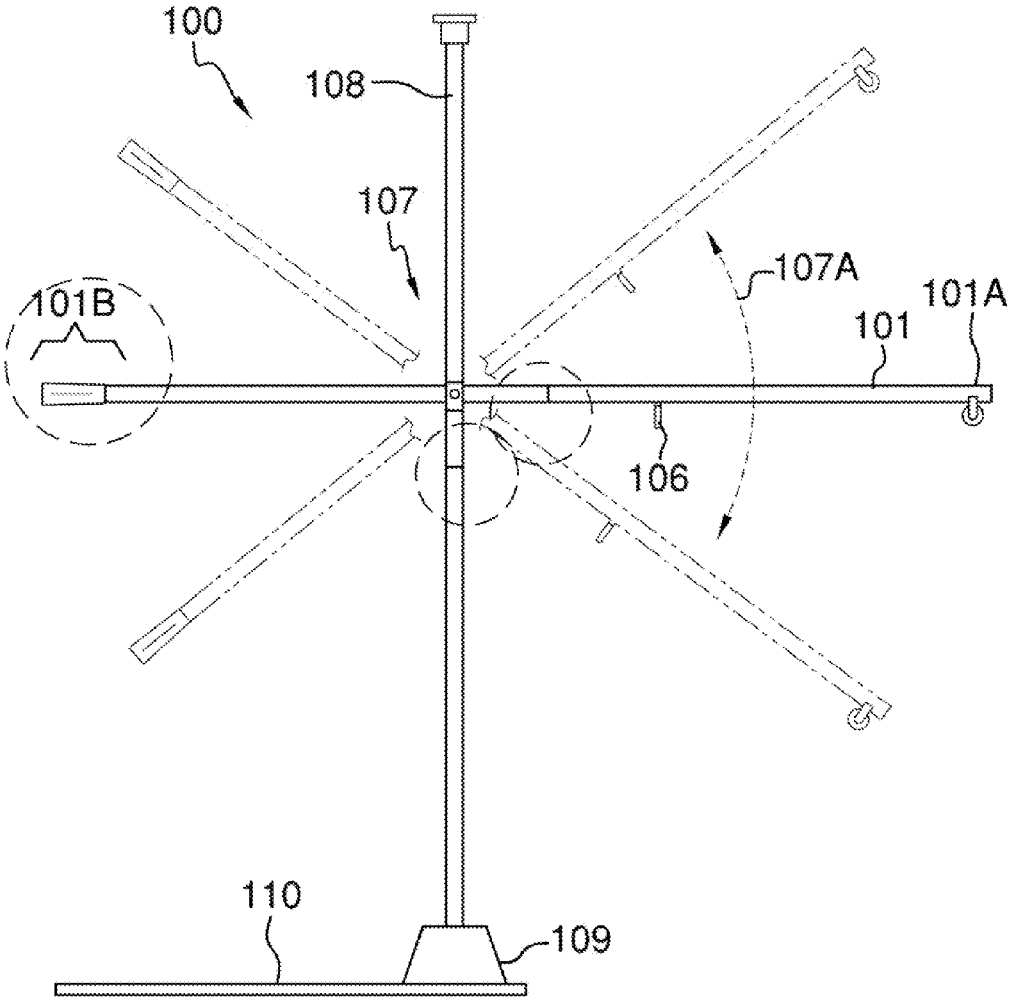
FIG. 2 illustrates a side view of the piñata hanging and swinging apparatus in which the boom pipe and handle are articulated about a pivot point shared with the support, and detailing the weight block and base located under the support.
Figure 3:
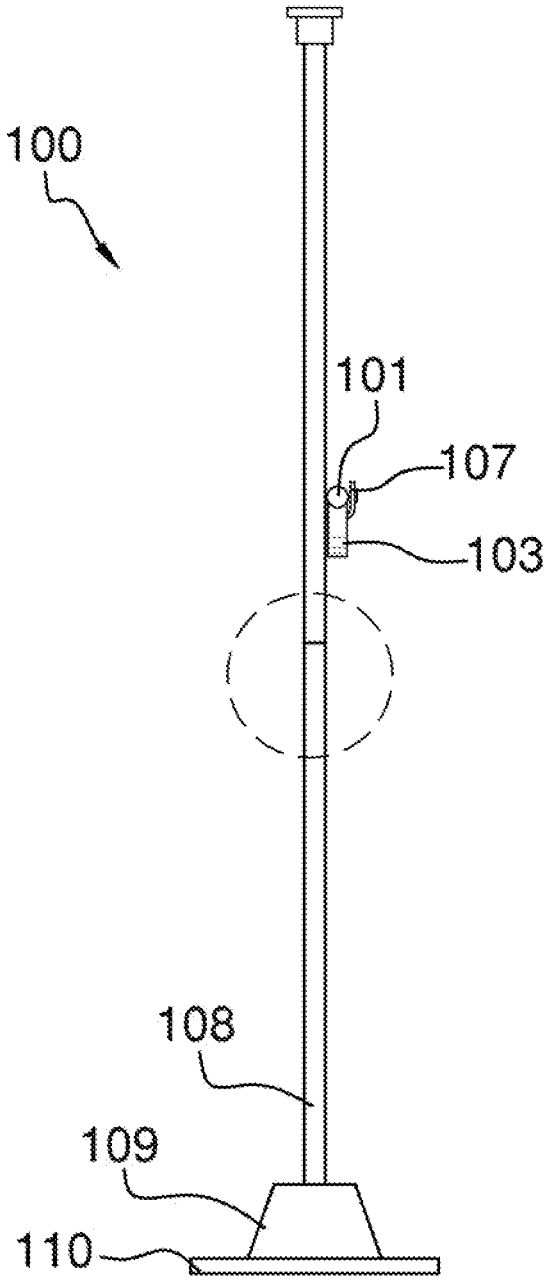
FIG. 3 illustrates a back view of the piñata hanging and swinging apparatus by itself.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4. A piñata hanging and swinging apparatus 100 (hereinafter invention) includes a boom pipe 101 of an undefined length. The boom pipe 101 has a pulley 102 located at a first end 101A, and a handle 103 located at a second end 101B. A hook 106 is located on the boom pipe 101 and enables a string 104 to pass through the pulley 102 down to a piñata 105. The string 104 shall extend down to where the handle 103 is located such that an end user can hold the string 104 with one hand while maneuvering the boom pipe 101 via the handle 103.

The boom pipe 101 is affixed to and pivots about a pivot point 107 via a vertical support 108. The pivot point 107 enables the boom pipe 101 to rotate up and down via a vertical axis 107A. The vertical support 108 is secured to and rotates about a weight block 109. The vertical support 108 can rotate about a horizontal axis 108A, such that the end user can raise, lower, and rotate the piñata 105 by articulating the handle 103 there about.

The base 110 is an elongated board onto which the weight block 109 is mounted. The shape of the base 110 is such that the end user can stand on the base 110 when articulating the boom pipe 101 via the handle 103.

Figure 4:
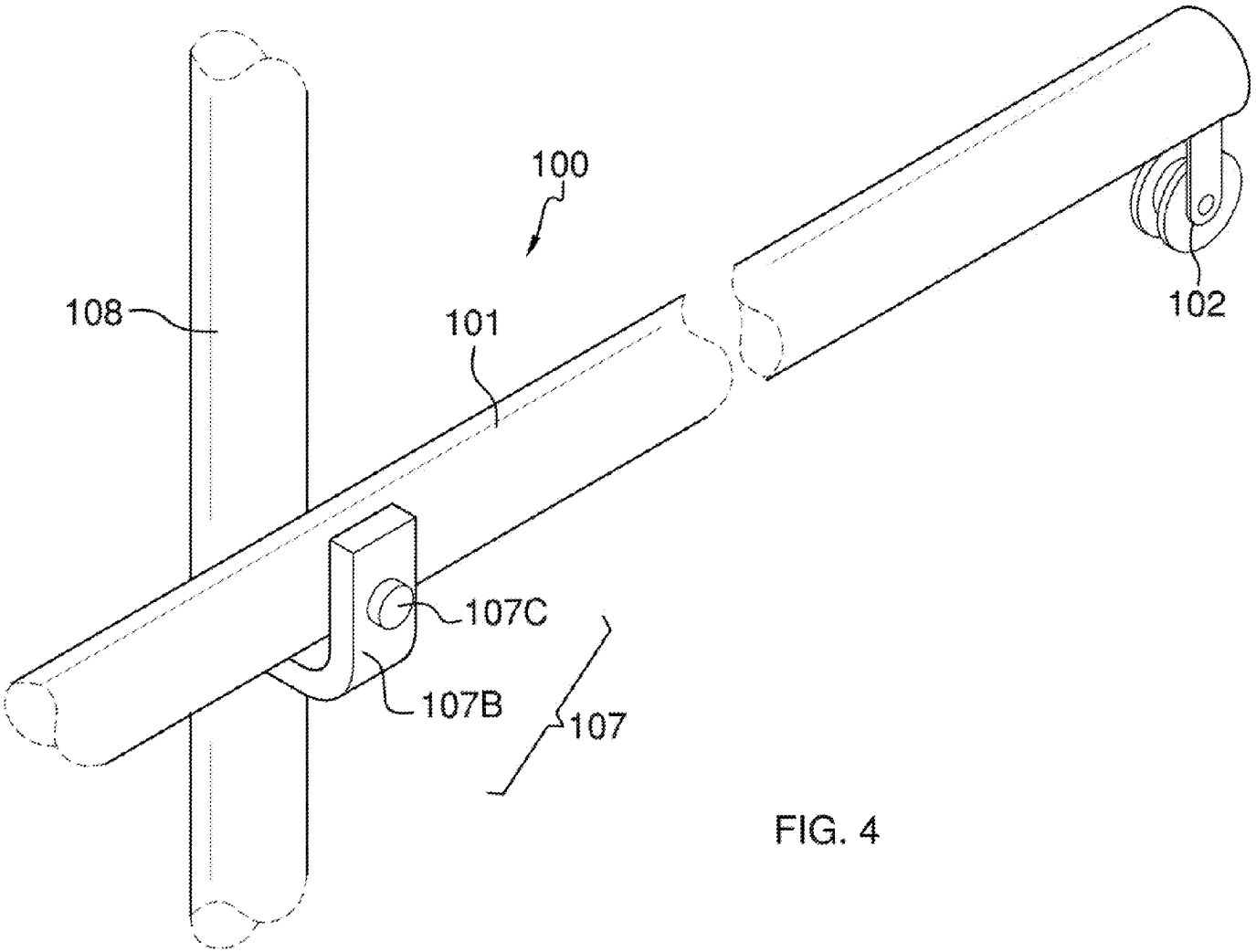
FIG. 4 illustrates a detailed view of the pivot point formed between the boom pipe and the support of the piñata hanging and swinging apparatus.

Referring to FIG. 4, the pivot point 107 is composed of an elbow-shaped bracket 107B that extends from a side surface of the vertical support 108. A pin 107C attaches the elbow-shaped bracket 107B to the boom pipe 101 at a middle point 101C. The distance between the first end 101A and the middle point 101C shall be greater than the distance between the middle point 101C and the second end 101B. Thus, the pivot point 107 provides movement of the boom pipe 101 about the vertical axis 107A.

It shall be noted that the range of movement of the boom pipe 101 with respect to the pivot point 107 can be no greater than 180 degrees; whereas movement of the vertical support 108 about the horizontal axis 108A can be 360 degrees in either clockwise or counterclockwise directions.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A piñata hanging and swinging apparatus, comprising: a boom pipe that includes a pulley on a first end and a handle on a second end; wherein the boom pipe pivots about a pivot point that attaches to a vertical support wherein the pivot point is further defined by an elbow-shaped bracket being open at a top portion that extends from a side surface of the vertical support; wherein a in attaches the elbow-shaped bracket to the boom pipe; wherein a piñata attaches to a string and extends down from the pulley wherein an end user manipulates the handle to move the piñata thereon; wherein the vertical support attaches to and rotates about a horizontal axis such that the boom pipe can be rotated and raised and lowered; wherein the vertical support attaches to a weight block; wherein the weight block is attached atop a base; wherein the base is an elongated board onto which an end user stands when manipulating said piñata.

2. The piñata hanging and swinging apparatus as described in claim 1 wherein a hook attaches to the boom pipe and threads the string from the handle to the pulley and down to the piñata.

3. The piñata hanging and swinging apparatus as described in claim 1 wherein a range of movement of the pivot point can be no greater than 180 degrees; whereas movement of the vertical support about the horizontal axis can be 360 degrees in either clockwise or counterclockwise directions.

4. The piñata hanging and swinging apparatus as described in claim 1 wherein the pin attaches the elbow-shaped bracket to the boom pipe at a middle point.

5. The piñata hanging and swinging apparatus as described in claim 4 wherein the distance between the first end and the middle point shall be greater than the distance between the middle point and the second end.

6. A piñata hanging and swinging apparatus, comprising: a boom pipe that includes a pulley on a first end and a handle on a second end; wherein the boom pipe pivots about a pivot point that attaches to a vertical support; wherein a piñata attaches to a string and extends down from the pulley wherein an end user manipulates the handle to move the piñata thereon; wherein the pivot point is further defined by an elbow-shaped bracket being open at a top portion that extends from a side surface of the vertical support; wherein a pin attaches the elbow-shaped bracket to the boom pipe; wherein the vertical support attaches to and rotates about a horizontal axis such that the boom pipe can be rotated and raised and lowered; wherein the pin attaches the elbow-shaped bracket to the boom pipe at a middle point; wherein the vertical support attaches to a weight block; wherein the weight block is attached atop a base; wherein the base is an elongated board onto which an end user stands when manipulating said piñata; wherein a hook attaches to the boom pipe and threads the string from the handle to the pulley and down to the piñata.

7. The piñata hanging and swinging apparatus as described in claim 6 wherein a range of movement of the pivot point can be no greater than 180 degrees; whereas movement of the vertical support about the horizontal axis can be 360 degrees in either clockwise or counterclockwise directions.

8. The piñata hanging and swinging apparatus as described in claim 6 wherein the distance between the first end and the middle point shall be greater than the distance between the middle point and the second end.

* * * * *